US010333213B2

(12) United States Patent
Zolomy et al.

(10) Patent No.: US 10,333,213 B2
(45) Date of Patent: Jun. 25, 2019

(54) APPARATUS WITH IMPROVED ANTENNA ISOLATION AND ASSOCIATED METHODS

(71) Applicant: Silicon Laboratories Inc., Austin, TX (US)

(72) Inventors: Attila Zolomy, Budapest (HU); Tamas Bodi, Budapest (HU); Tibor Herman, Budapest (HU); Terry Lee Dickey, Pflugerville, TX (US)

(73) Assignee: Silicon Laboratories Inc., Austin, TX (US)

( * ) Notice: Subject to any disclaimer, the term of this patent is extended or adjusted under 35 U.S.C. 154(b) by 156 days.

(21) Appl. No.: 15/370,724

(22) Filed: Dec. 6, 2016

(65) Prior Publication Data

US 2018/0159214 A1 Jun. 7, 2018

(51) Int. Cl.
*H01Q 1/52* (2006.01)
*H01Q 9/42* (2006.01)
*H01Q 21/28* (2006.01)

(52) U.S. Cl.
CPC ..... *H01Q 1/521* (2013.01); *H01Q 9/42* (2013.01); *H01Q 21/28* (2013.01)

(58) Field of Classification Search
CPC ..... H01Q 1/52; H01Q 1/521; H01Q 1/525; H01Q 1/528; H01Q 9/0421; H01Q 9/42; H01Q 21/28
See application file for complete search history.

(56) References Cited

U.S. PATENT DOCUMENTS

| | | | | |
|---|---|---|---|---|
| 5,463,406 | A | 10/1995 | Vannatta et al. | |
| 5,990,838 | A | 11/1999 | Burns et al. | |
| 6,292,153 | B1 | 9/2001 | Aiello et al. | |
| 6,560,443 | B1 | 5/2003 | Vaisanen et al. | |
| 6,570,538 | B2 | 5/2003 | Vaisanen et al. | |
| 6,795,021 | B2 | 9/2004 | Ngai et al. | |
| 7,592,969 | B2 | 9/2009 | Proctor, Jr. et al. | |
| 7,595,759 | B2 | 9/2009 | Schlub et al. | |
| 7,688,273 | B2 | 3/2010 | Montgomery et al. | |
| 8,144,063 | B2 | 3/2012 | Schlub et al. | |
| 2006/0038736 | A1 | 2/2006 | Hui et al. | |
| 2014/0225800 | A1 | 8/2014 | Jenwatanavet | |
| 2016/0240930 | A1* | 8/2016 | Cozzolino ..... | H01Q 1/521 |

* cited by examiner

*Primary Examiner* — Robert Karacsony
(74) *Attorney, Agent, or Firm* — Law Offices of Maximilian R. Peterson

(57) ABSTRACT

An apparatus includes a first antenna coupled to a first radio frequency (RF) circuit to receive or transmit RF signals, and a second antenna coupled to a second RF circuit to receive or transmit RF signals. The apparatus further includes a first RF current blocker disposed between the first and second antennas, and a second RF current blocker disposed between the first and second antennas. The first and second RF current blockers increase isolation between the first and second antennas.

20 Claims, 10 Drawing Sheets

APPARATUS WITH IMPROVED ANTENNA ISOLATION AND ASSOCIATED METHODS

TECHNICAL FIELD

The disclosure relates generally to communication apparatus and processes and, more particularly, to communication apparatus with multiple antennas with improved isolation, and associated methods.

BACKGROUND

With the increasing proliferation of wireless technology, such as Wi-Fi, Bluetooth, and mobile or wireless Internet of things (IoT) devices, more devices or systems incorporate radio frequency (RF) circuitry, such as receivers and/or transmitters. A variety of types and circuitry for transmitters and receivers are used. Transmitters send or transmit information via a medium, such as air, using RF signals. Receivers at another point or location receive the RF signals from the medium, and retrieve the information.

The RF circuitry typically uses antennas to receive (in the case of receivers) or transmit (in the case of transmitters) RF signals. To increase performance, such as throughput, bandwidth, speed, etc., the RF circuitry may use multiple antennas. The multiple antennas may be used in a variety of schemes, such as beam-forming, antenna diversity, multiple-input and multiple-output (MIMO), etc. For example, some wireless communication standards, such as IEEE 802.11n, IEEE 802.11ac, HSPA+, WiMAX, and Long Term Evolution (LTE) use MIMO techniques. Modulation techniques are used to address problems in a MIMO setting, such as multi-path communication channels.

The description in this section and any corresponding figure(s) are included as background information materials. The materials in this section should not be considered as an admission that such materials constitute prior art to the present patent application.

SUMMARY

A variety of communication apparatus with multiple antennas having improved isolation and associated methods are contemplated. According to one exemplary embodiment, an apparatus includes a first antenna coupled to a first radio frequency (RF) circuit to receive or transmit RF signals, and a second antenna coupled to a second RF circuit to receive or transmit RF signals. The apparatus further includes a first RF current blocker disposed between the first and second antennas, and a second RF current blocker disposed between the first and second antennas. The first and second RF current blockers increase isolation between the first and second antennas.

According to another exemplary embodiment, an apparatus includes a first antenna disposed along a first edge of a substrate, and a second antenna disposed along a second edge of the substrate. The apparatus further includes a first RF current blocker disposed along a third edge of the substrate, and a second RF current blocker disposed along a fourth edge of the substrate.

According to another exemplary embodiment, a method of increasing antenna isolation between first and second antennas in a multi-antenna apparatus includes fabricating the first antenna, the first antenna being coupled to a first radio frequency (RF) circuit to receive or transmit RF signals, and fabricating the first antenna, the second antenna being coupled to a second RF circuit to receive or transmit RF signals. The method further includes fabricating a first RF current blocker disposed between the first and second antennas, fabricating a second RF current blocker disposed between the first and second antennas. The first and second RF current blockers increase isolation between the first and second antennas.

BRIEF DESCRIPTION OF THE DRAWINGS

The appended drawings illustrate only exemplary embodiments and therefore should not be considered as limiting the scope of the application or the claims. Persons of ordinary skill in the art will appreciate that the disclosed concepts lend themselves to other equally effective embodiments. In the drawings, the same numeral designators used in more than one drawing denote the same, similar, or equivalent functionality, components, or blocks.

DETAILED DESCRIPTION

Figure 1:
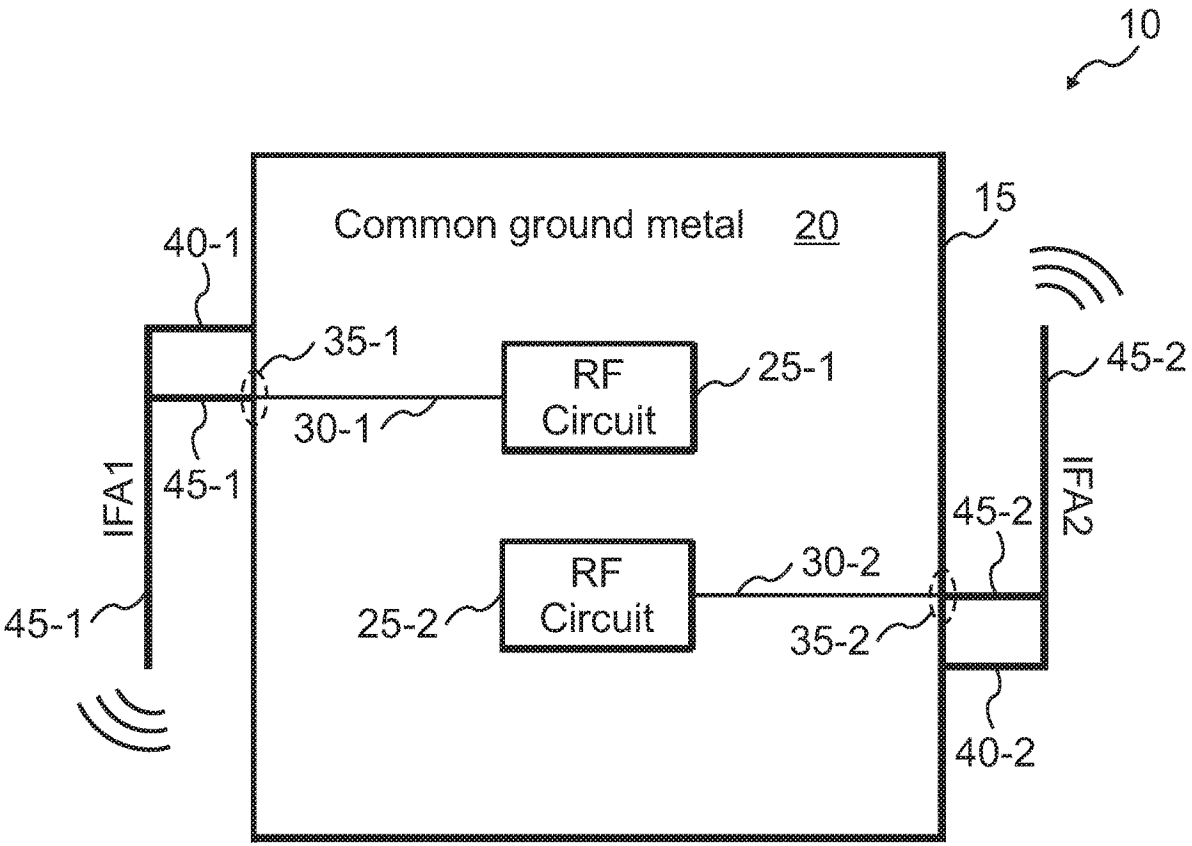
FIG. 1 illustrates an apparatus with a multi-antenna configuration.

The disclosed concepts relate generally to communication apparatus, such as transmitters, receivers, and transceivers, with multiple antennas. More specifically, the disclosed concepts relate to multi-antenna communication apparatus with improved antenna isolation and associated methods.

In multi-antenna (or multiple-antenna) apparatus, the antennas co-exist, i.e., they are situated in relative close proximity to one another. Typically, the antennas operate in the same or close bands. In other words, the antennas send or receive RF frequencies that fall in the same band of frequencies (e.g., for a given or specified wireless communication standard or protocol, such as the 2.4-GHz band for Wi-Fi) or are relatively close to one another (e.g., the frequencies differ by a relatively small percentage, say 1-10%).

In such situations, various mechanisms cause interference among the antennas. In other words, interference between the antennas results in degradations in the received or transmitted RF signals. As a consequence, the performance of the RF apparatus, such as receiver, transmitter, or transceiver and, hence, the overall communication apparatus or system suffers or is degraded.

In multi-antenna situations such as those described above, antenna isolation may be considered as a figure of merit for a given implementation. Antenna isolation refers to the electrical isolation of the antennas in a multi-antenna configuration that reduces electrical interference among the antennas.

Multi-antenna co-existence configurations may be managed or unmanaged. In managed co-existence operation, a scheme, such as a communication protocol, standard, circuit, or device is used to synchronize and arrange the operation of the respective antennas. The aim of arranging the operation of the antennas is to reduce or avoid interference.

The degree to which such arrangements are effective in reducing interference varies depending on various factors, such the effectiveness of the measures taken, the closeness (both electrically (e.g., frequency) and physically) of the antennas to one another, etc., as persons of ordinary skill in the art will understand. Antenna isolation is one indication or characterization of the degree to which the measures taken succeed or are effective in combating electrical interference among the antennas and the electrical signals that they transmit or receive.

In unmanaged co-existence operation, typically no measures are taken to synchronize the operation of the multiple antennas. In other words, no measures are taken to coordinate the operation of the various antennas (e.g., in time, in frequency, or both) in such a configuration. As a result, electrical interference typically occurs randomly in such situations.

Several mechanisms for electrical interference among antennas exist. Coupling can occur because of far fields. In such a situation, a passive (not transmitting) antenna receives the far field transmission of an active (transmitting) antenna. Far field radiation coupling becomes a dominant interference mechanism in situations where the distance among the antennas in a multi-antenna configuration is equal to or larger than two wavelengths ($2\lambda$) of the RF signals that are transmitted or received.

In the case of small substrates (e.g., printed circuit board (PCB), circuit carrier, RF module, etc.), the distance between adjacent antennas in a multi-antenna configuration might be smaller than two wavelengths ($2\lambda$) of the RF signals that are transmitted or received. In such a configuration, relatively strong coupling among the antennas because of near fields exists. As a result of the relatively strong coupling, the interference among the antennas is also relatively strong.

In addition, in multi-antenna configurations, undesired (or parasitic or unintended or unwanted) ground currents may also give rise to interference. In multi-antenna configurations where the distance between adjacent antennas is smaller than two wavelengths ($2\lambda$) of the RF signals that are transmitted or received, relatively large undesired ground currents exist. As a result of the ground currents, the interference among the antennas is also relatively strong. Thus, in situations where the distance among the antennas in a multi-antenna configuration is less than two wavelengths ($2\lambda$), near field coupling and undesired ground currents are the dominant interference mechanisms.

In exemplary embodiments, measures are taken to reduce the undesired ground currents in a multi-antenna configuration, as described below in detail. As a result, interference among antennas because of undesired ground currents is reduced. Consequently, antenna isolation among the antennas is increased or improved.

To facilitate presentation of the concepts, the apparatus and techniques for improving antenna isolation are described in this document with reference to a particular type of antenna, namely an Inverted-F Antenna (IFA). Use of IFAs, however, constitutes merely one example of the type antenna that may be used with the disclosed apparatus and techniques. In exemplary embodiments, other types of antenna may be used, as desired. As one example, printed antennas may be used. As additional examples, Inverted L Antenna (ILA), printed monopole, meandered monopole, half loop antennas, spiral antennas, or ceramic antennas may be used. The choice of antenna used depends on a number of factors, such as available technology, cost, performance, design and performance specifications, physical attributes (size, geometry) available or desired, etc., as persons of ordinary skill in the art will understand.

FIG. 1 illustrates an apparatus 10 with a multi-antenna configuration. More specifically, apparatus 10 includes two antennas, labeled IFA1 and IFA2, respectively, configured or attached to a substrate 15. Antenna IFA1 is coupled to RF circuit 25-1 via link 30-1 and feed point 35-1.

RF circuit 25-1 may have a variety of designs or configurations. For example, RF circuit 25-1 may be a receiver, a transmitter, or a transceiver. As another example, RF circuit 25-1 may be an RF module that is attached to substrate 15. Similarly, RF circuit 25-2 may be a receiver, a transmitter, or a transceiver. In some situations, RF circuit 25-2 may be an RF module that is attached to substrate 15. In yet other situations, substrate 15 may be part of an RF module that includes some or all parts of antenna IFA1 and antenna IFA2.

Link 30-1 is typically a transmission line, such as a stripline or similar structure. Through link 30-1, RF signals may either be received from antenna IFA1 (in the case of RF reception) or supplied to antenna IFA1 (in the case of RF transmission). Feed point 35-1 may have a variety of structures, such as a connector, coupling mechanism, etc.

Antenna IFA1, an inverted-F antenna in the example shown, has radiators 45-1 coupled to feed point 35-1 and loop 40-1. As noted above, other types of antenna may be used, as desired.

Substrate 15 provides a mechanism for attaching and supporting various components of apparatus 10, such as RF circuit 25-1, RF circuit 25-2, feed point 35-1, feed point 35-2, antenna IFA1 (or parts of it), and antenna IFA2 (or parts of it). Generally, substrate 15 may be made from a variety of materials. Examples include PCB materials (such as FR4), or other insulating substrates with a conductive layer attached or adhered to one or more surfaces (e.g., the top surface) of it.

Substrate 20 is covered with a conductive material 20, such as metal, that is electrically common (labeled "Common ground metal 20" or common ground plane 20) to antenna IFA1 and antenna IFA2. For instance, in the example shown, common ground plane 20 provides a ground connection or coupling point for one or more of antenna IFA1, antenna IFA2, RF circuit 25-1, and RF circuit 25-2.

Depending on the material type and configuration or design of various circuit elements (such as link 30-1, link 30-2, feed point 35-1, feed point 35-2, RF circuit 25-1, RF circuit 25-2), isolation regions (not shown) may be provided around some of the circuit elements. For example, isolation regions may be provided around link 30-1, link 30-2, feed point 35-1, feed point 35-2, RF circuit 25-1, and/or RF circuit 25-2 such that common ground plane 20 extends to those circuit elements, but does not electrically touch or contact them.

Isolation regions may be fabricated in a variety of manners. For example, if substrate 15 constitutes a PCB, isolation regions may be fabricated by etching portions of common ground plane 20 (copper layer). The isolation regions would surround the circuit elements so as to isolate the circuit elements from common ground plane 20.

Generally, antenna IFA2 may have the same or a different structure than antenna IFA1. In the example shown, antenna IFA2 has a similar structure to the structure of antenna IFA1. More specifically, antenna IFA2 is coupled to RF circuit 25-2 via link 30-2 and feed point 35-2. In exemplary embodiments, RF circuit 25-2 may be a receiver, a transmitter, or a transceiver.

Link 30-2 is typically a transmission line, such as a stripline or similar structure. Through link 30-2, RF signals may either be received from antenna IFA2 (in the case of RF reception) or supplied to antenna IFA2 (in the case of RF transmission). Feed point 35-2 may have a variety of structures, such as a connector, coupling mechanism, etc.

Antenna IFA2, an inverted-F antenna in the example shown, has radiators 45-2 coupled to feed point 35-2 and loop 40-2. As noted above, other types of antenna may be used, as desired. As further noted above, antenna IFA1 and antenna IFA2 may be the same or different types and/or sizes of antenna, as desired.

Figure 2:
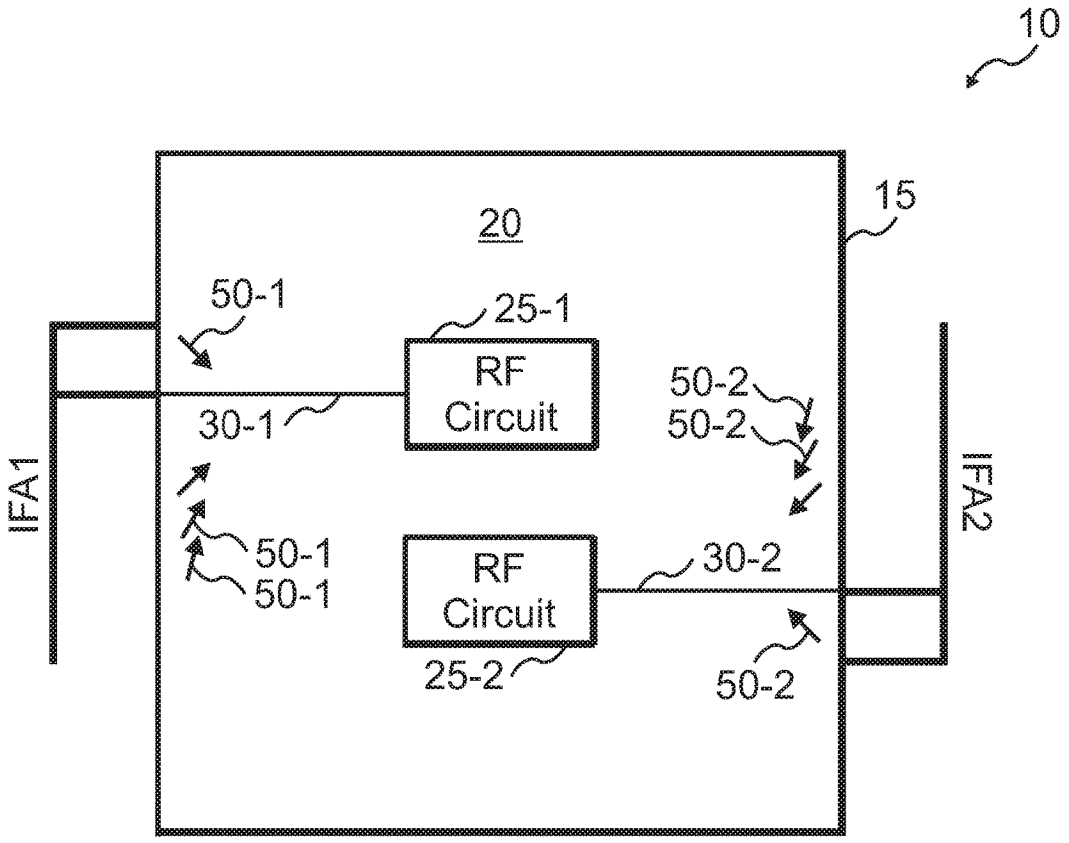
FIG. 2 depicts the flow of ground-plane currents in a multi-antenna apparatus.

Operation of RF circuit 25-1 and/or RF circuit 25-2 gives rise to ground currents. The ground currents flow at least in part in common ground plane 20. FIG. 2 depicts the flow of ground-plane currents in multi-antenna apparatus 10. In the example shown in FIG. 2, both antenna IFA1 and antenna IFA2 are excited (e.g., transmitting RF signals).

Arrows labeled 50-1 show the path of current flowing in common ground plane 20 near antenna IFA2. The current flowing along path 50-1 constitutes the current flowing in common ground plane 20 that is associated with the operation of antenna MAL More specifically, the current flowing along path 50-1 results from RF radiation from antenna IFA1 in order to transmit or radiate the desired RF signal, i.e., the current flowing along path 50-1 is a desired current (or conduction current or intended current or useful current (i.e., useful for the transmission of RF signals by antenna IFA1)).

Similarly, arrows labeled 50-2 show the path of current flowing in common ground plane 20 near antenna IFA2. The current flowing along path 50-2 constitutes the current flowing in common ground plane 20 that is associated with the operation of antenna IFA2. Put another way, the current flowing along path 50-2 results from RF radiation from antenna IFA2 in order to transmit or radiate the desired RF signal. Thus, the current flowing along path 50-2 is a desired current (or conduction current or intended current or useful current (i.e., useful for the transmission of RF signals by antenna IFA2)).

The flow of currents shown in FIG. 2 "completes" the circuit for antennas IFA1 and IFA2 so that the antennas properly radiate desired or intended RF signals. In that sense, the designer or manufacturer of apparatus 10 intends for the currents shown to flow along paths 50-1 and 50-2, respectively. Accordingly, the currents flowing along paths 50-1 and 50-2 constitute intended currents, which arise from the intended operation of antenna IFA1 and antenna IFA2, respectively.

Figure 3:
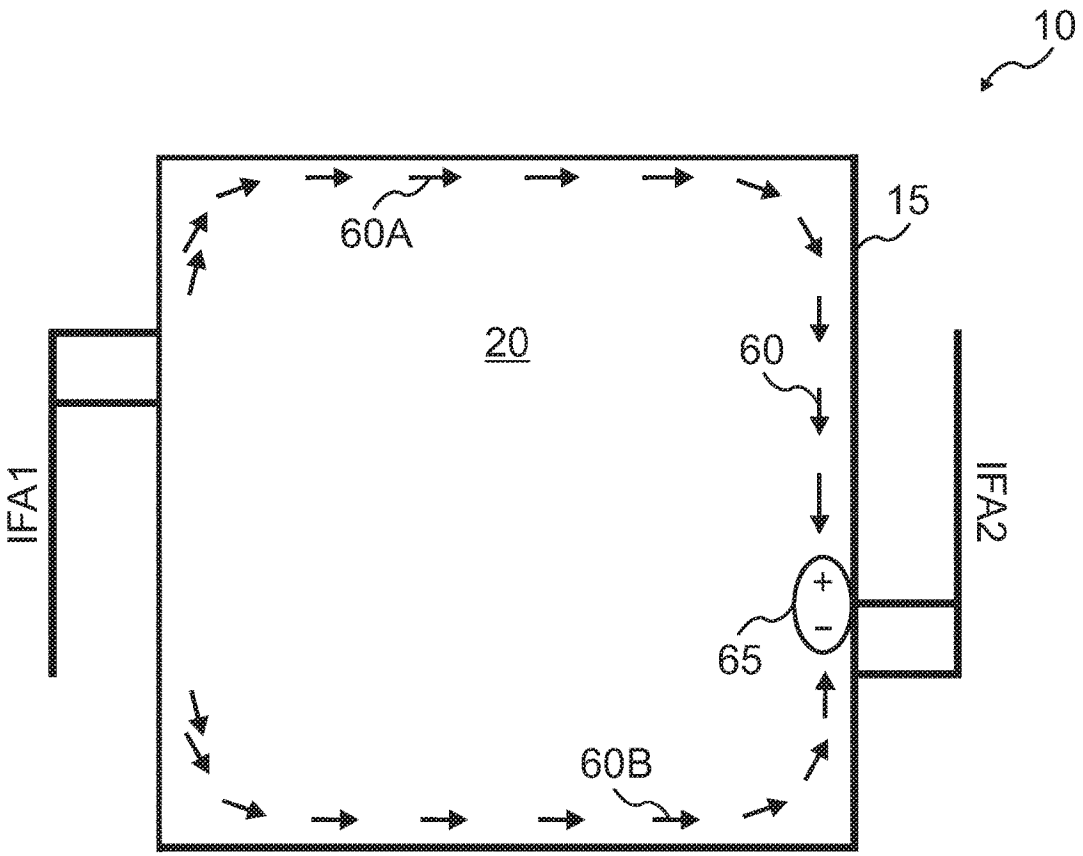
FIG. 3 shows the flow of undesired ground-plane currents in a multi-antenna apparatus.

Operation of antenna IFA1 and/or antenna IFA2, however, also gives rise to undesired ground currents, which can give rise to electrical interference, as described above. FIG. 3 shows the flow of undesired ground or ground-plane currents in multi-antenna apparatus 10 (some circuit elements or blocks, such as link 30-1, link 30-2, RF circuit 25-1, and RF circuit 25-2 have been omitted to facilitate presentation).

Undesired ground currents flow along path 60A and path 60B in FIG. 3. The undesired ground currents typically flow or propagate along the circumference or relatively close to the edges of substrate 15. The edges of substrate 15 behave as a parasitic waveguide because of the distributed (fringe) capacitance and inductance associated with substrate 15.

In the example shown in FIG. 3, antenna IFA1 is excited, whereas antenna IFA2 is not. Undesired ground currents flow along path 60A from IFA1 to IFA2. In addition, undesired ground currents flow along path 60B from IFA1 to IFA2. Flow of current along paths 60A and 60B gives rise to a potential at or near IFA2 (e.g., near feed point 35-2 (not shown)). In other words, the superposition of opposing currents flowing along path 60A and path 60B, respectively, gives rise to a parasitic potential that couples to antenna IFA2, and causes electrical interference with the proper or intended operation of antenna IFA2.

To mitigate or reduce the effects of the undesired ground currents, RF current blockers may be used. The use of the RF current blockers reduces the effect of the undesired ground currents. As a result, the use of RF current blockers increases antenna isolation.

Figure 4:
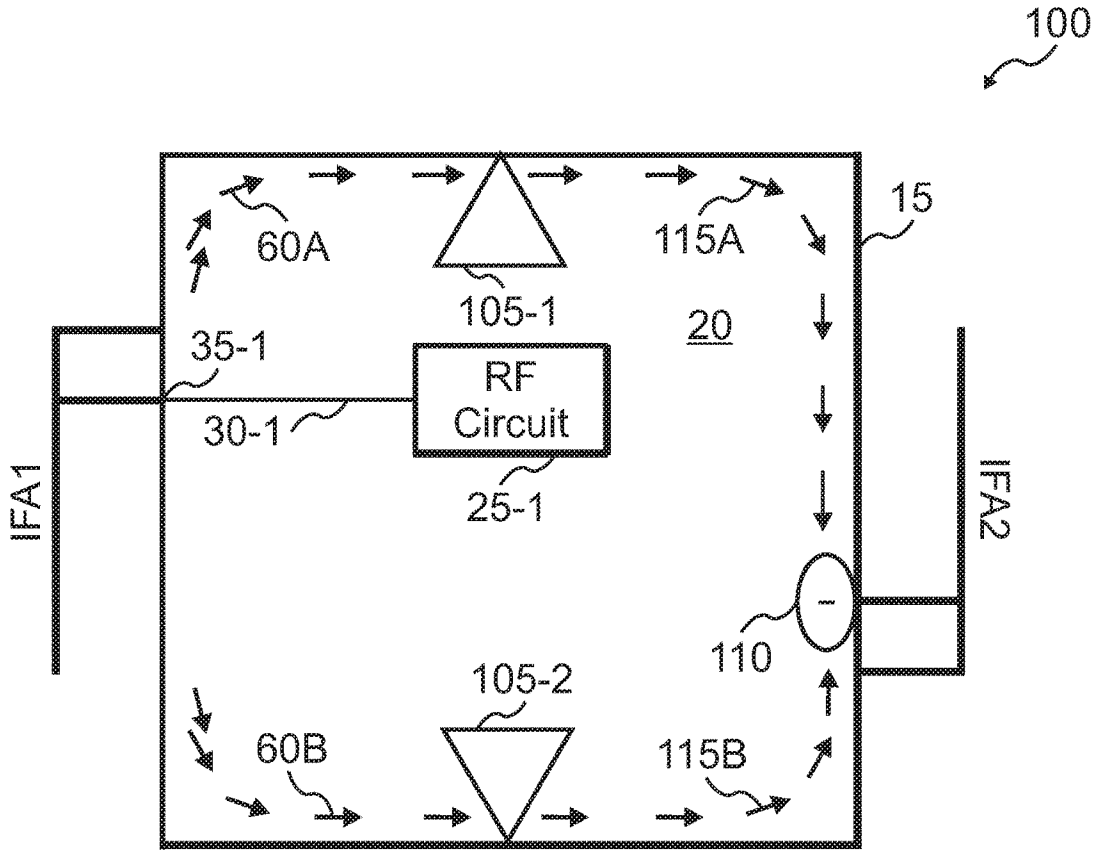
FIG. 4 depicts a multi-antenna apparatus with RF current blockers added to increase antenna isolation.

FIG. 4 depicts a multi-antenna apparatus 100 with RF current blockers 105-1 and 105-2 added to increase antenna isolation (RF circuit 25-2 and link 30-2 are omitted to facilitate presentation). Use of RF current blockers 105-1 and 105-2 blocks the flow of undesired ground currents propagating along the circumference or edges of substrate 15. The RF current blockers behave as open circuits, and block or nearly block the flow of undesired currents by acting as open circuits in the path of current flow. As a result, the undesired coupling and resulting interference because of undesired ground currents is reduced, which increases antenna isolation between antenna IFA1 and antenna IFA2.

Even though RF current blockers block nearly all of the undesired ground currents, some residual leakage current will flow in common ground plan 20 (i.e., antenna isolation is not perfect, even though improved or increased compared to when the RF current blockers are not used). The residual leakage currents flow along path 115A and path 115B towards antenna IFA2.

RF current blockers 105-1 and 105-2, however, also cause phase shifts in the residual leakage currents flowing along paths 115A and 115B. The positions of RF current blocker 105-1 and RF current blocker 105-2 between antenna IFA1 and antenna IFA2 along the top and bottom edges of substrate 15 is selected such that the residual leakage current signals have opposite phases.

As a result, the superposition of the residual leakage currents at or near antenna IFA2 causes the residual leakage currents or their effects on the operation of antenna IFA2 to cancel or nearly cancels (as shown by the presence of potential 110). Consequently, interference as a result of coupling from undesired ground currents is reduced or suppressed, which in effect increases antenna isolation. the coupling.

Note that RF current blocker 105-1 and RF current blocker 105-2 are positioned at or along or near the top and bottom edges of substrate 15, whereas antenna IFA1 and antenna IFA2 are positioned at or along or near the left and right edges of substrate 15. The positioning of RF current blocker 105-1 and RF current blocker 105-2 in this manner reduces their effect on the impedance and tuning of antenna IFA1 and antenna IFA2 (i.e., reduces the effect of RF current blocker 105-1 and RF current blocker 105-2 on the desired conduction currents of antennas IFA1 and IFA2).

Nevertheless, the use of RF current blocker 105-1 and RF current blocker 105-2 might cause a change in the impedance and/or tuning of IFA1 and/or antenna IFA2. In other words, the effects of RF current blocker 105-1 and RF current blocker 105-2 on antenna impedance and/or tuning might not be fully eliminated as in the original substrate (before adding RF current blockers) the undesired currents are also part of the total ground current, and thus influence the antenna impedance). Thus, after positioning and fabrication of RF current blocker 105-1 and RF current blocker 105-2, tuning of antenna IFA1 and/or antenna IFA2 may be performed in order to correct or compensate for the effects of RF current blocker 105-1 and/or RF current blocker 105-2.

In some embodiments, RF current blockers 105-1 and 105-2 are implemented as slot line radial stubs. More specifically, RF current blocker 105-1 is implemented as one slot line radial stub, whereas RF current blocker 105-1 is implemented as another slot line radial stub. The slot line radial stubs behave as open circuits at their inputs. RF current blocker 105-1 and RF current blocker 105-2 may be implemented in other ways, as desired. The choice of RF current blocker 105-1 and RF current blocker 105-2 depends on a number of factors, such as design and performance specifications, available technology, material properties, characteristics such as frequency band of operation, type of antenna, etc., as persons of ordinary skill in the art will understand.

RF current blockers may be used in multi-antenna apparatus that have more than two antennas. For instance, RF current blockers may be used in apparatus that have four or more antennas. As the number of antennas increases, the number of RF current blockers may also be increased to help block or suppress undesired ground currents, as desired, and as described above.

Figure 5:
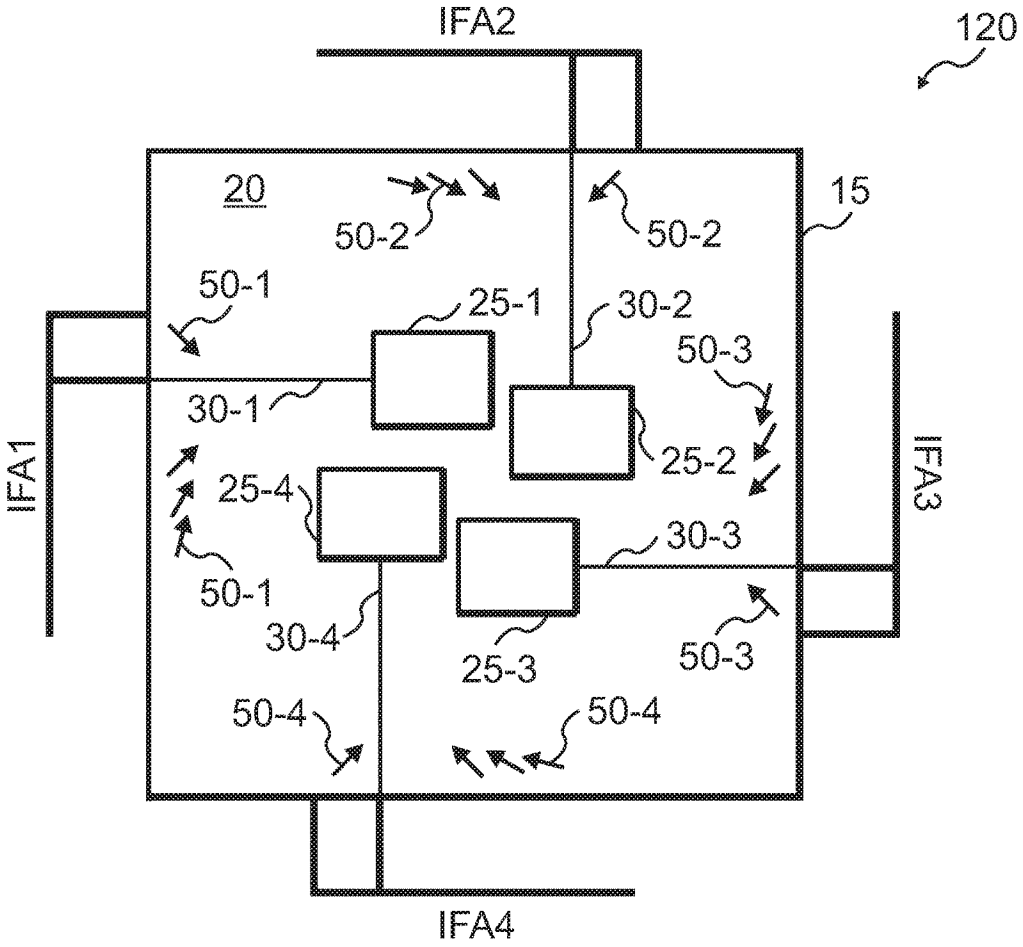
FIG. 5 illustrates an apparatus with a multi-antenna configuration.

By way of example, FIG. 5 illustrates an apparatus 120 with a multi-antenna configuration that uses 4 antennas, labeled as IFA1 through IFA4. Antennas IFA1-IFA4 couple to RF circuits 25-1 through RF circuits 25-4 via links 30-1 through 30-4 and feed points 35-1 through 35-4 (not shown), respectively. RF circuits 25-1 through RF circuits 25-4, links 30-1 through 30-4, and feed points 35-1 through 35-4 (not shown) may have structures and configurations similar to those described above.

FIG. 5 also shows the flow of desired RF currents that arise from the operation of antennas IFA1-IFA4. More specifically, desired RF current from the operation of antenna IFA1 flows along path 50-1, whereas desired RF current from the operation of antenna IFA2 flows along path 50-2. Similarly, desired RF current from the operation of antenna IFA3 flows along path 50-3, whereas desired RF current from the operation of antenna IFA4 flows along path 50-4.

Figure 6:
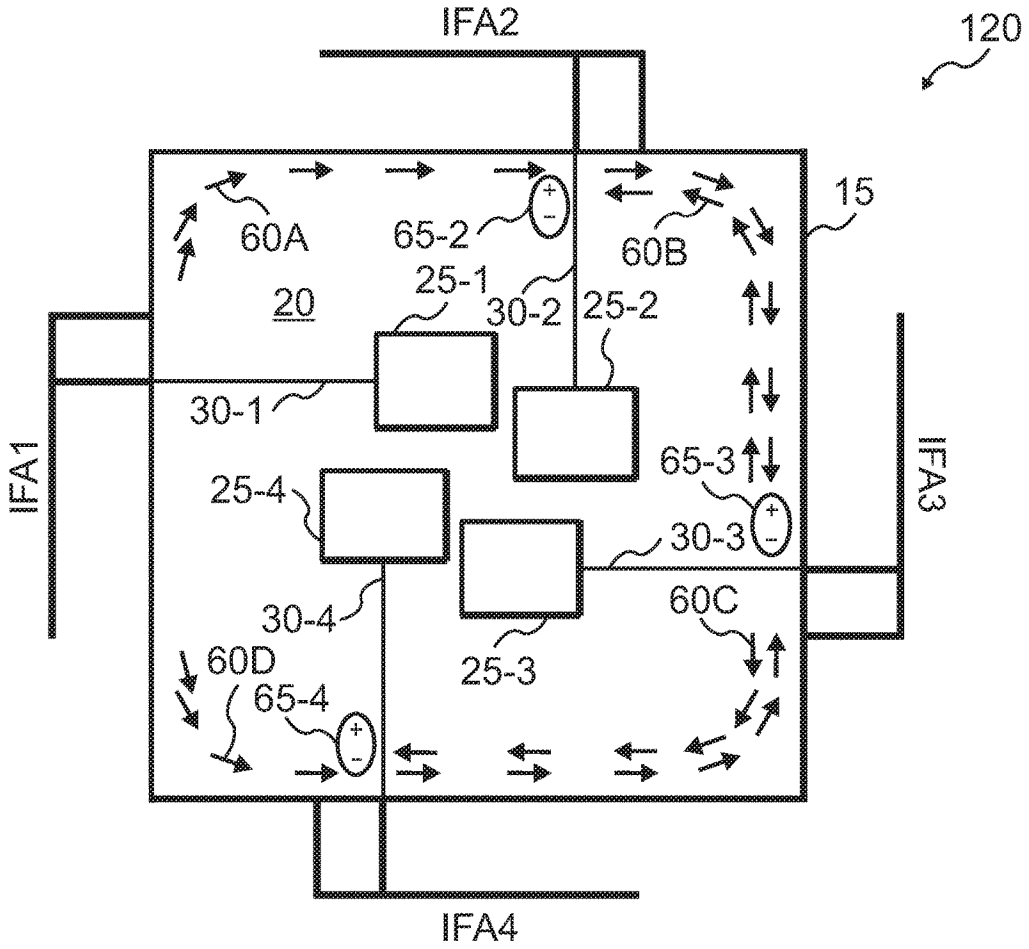
FIG. 6 depicts the flow of undesired ground-plane currents in a multi-antenna apparatus.

FIG. 6 depicts the flow of undesired ground-plane currents in multi-antenna apparatus 120. In the example shown in FIG. 6, antenna IFA1 is excited, whereas antenna IFA2, antenna IFA3, and antenna IFA4 are not. Undesired ground currents flow towards each of antennas IFA2-IFA4 along various paths 60A-60D. Similar to the situation described above, the superposition of the undesired ground currents results in parasitic or interference potential sources shown as 65-2 through 65-4 at or near the positions of antennas IFA2-IFA4, respectively.

Figure 7:
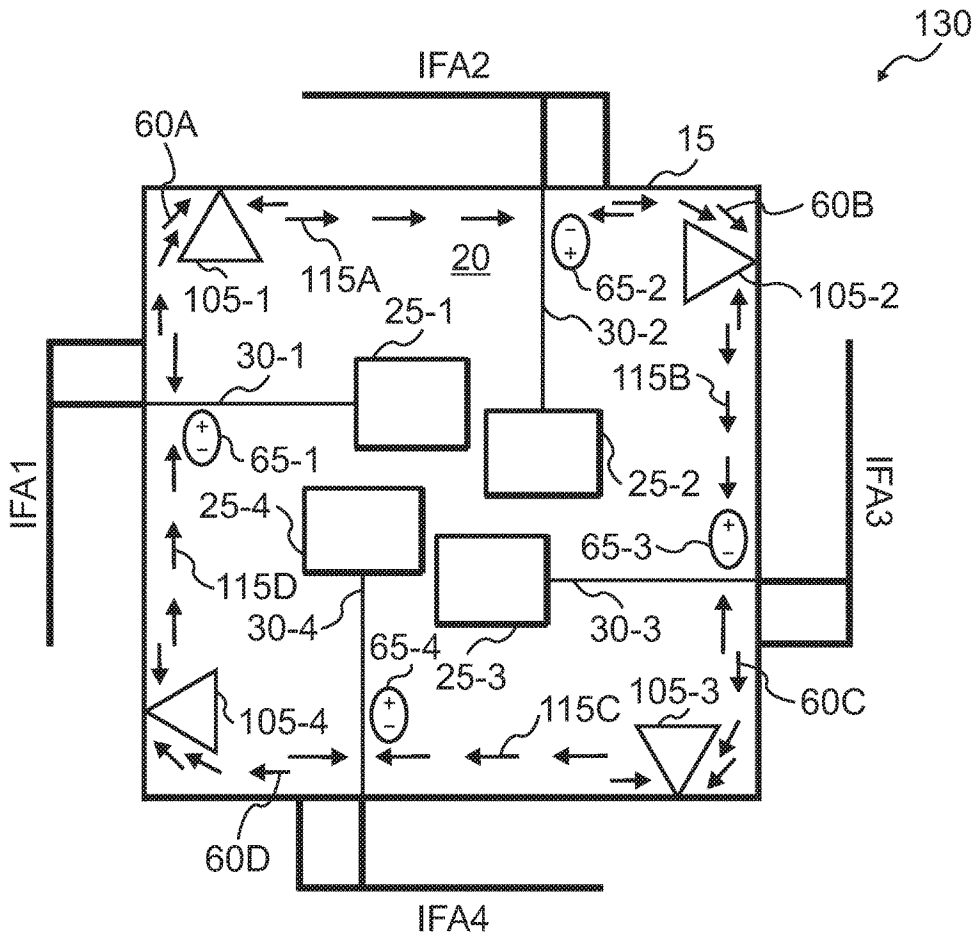
FIG. 7 illustrates a multi-antenna apparatus with RF current blockers added to increase antenna isolation.

FIG. 7 illustrates multi-antenna apparatus 130 with RF current blockers 105-1 through 105-4 added to increase antenna isolation. Note that RF blockers 105-1 through 105-4 are positioned between adjacent antennas. For example, RF blocker 105-1 is positioned at or near or along an edge between antenna IFA1 and antenna IFA2. As another example, RF blocker 105-2 is positioned at or near or along an edge between antenna IFA2 and antenna IFA3. As another example, RF blocker 105-3 is positioned at or near or along an edge between antenna IFA3 and antenna IFA4. Finally, RF blocker 105-4 is positioned at or near or along an edge between antenna IFA4 and antenna IFA1.

In this manner, RF current blockers 105-1 through 105-4 block or suppress undesired ground currents along paths 60A-60D, i.e., along the circumference or edges of substrate 15. The RF current blockers behave as open circuits, and block or nearly block the flow of undesired currents by acting as open circuits in the path of current flow. As a result, the undesired coupling and resulting interference because of undesired ground currents is reduced, which increases antenna isolation among antennas IFA1-IFA4.

Note that residual leakage currents flow along paths 115A-115D, which cause interference with antennas IFA1-IFA4. Nevertheless, because of the blocking or suppressing action of RF current blockers 105-1 through 105-4, the coupling to antennas IFA1-IFA4 (as denoted by potential sources 65-1 through 65-4) is weaker or reduced. Assuming that antennas IFA1-IFA4 are all excited, using of RF current blockers 105-1 through 105-4 improves antenna isolation on the order of 6 to 8 dB.

Although the above discussion and accompanying figures describe use of RF current blockers in apparatus that include two or four antennas, use of RF current blockers may be extended to different numbers of antennas, i.e., more than 4, as desired, by making appropriate modifications. Such modifications include use of additional RF current blockers, positioning the RF current blockers to reduce adverse effect on the antennas and yet to increase antenna isolation, etc., as persons of ordinary skill in the art will understand.

In general, RF current blockers are disposed between two antennas such that the flow of undesired ground current between the two antennas is reduced or blocked. Where possible, given the geometry of substrate 15 and the antennas, the RF current blockers are disposed far from (in some cases as far as possible) from the antennas such that the effects of the RF current blockers on the antenna impedances and/or tuning is reduced.

Figure 8:
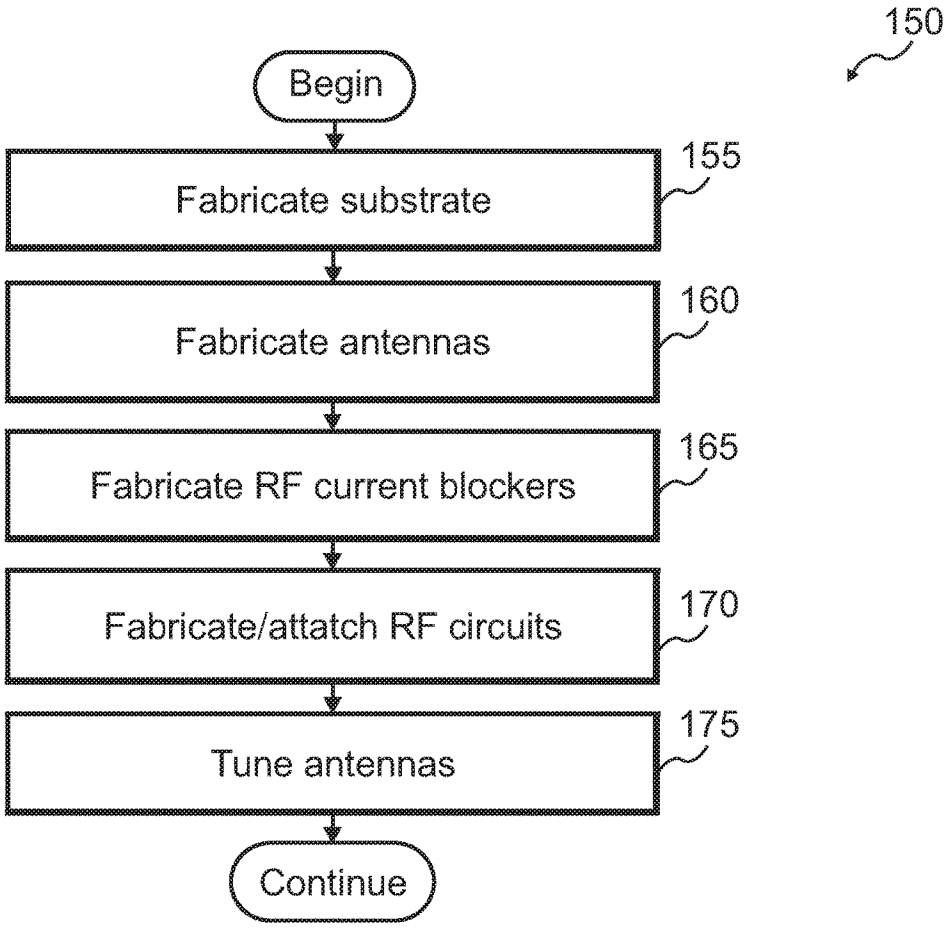
FIG. 8 shows a flow diagram for a process of fabricating an RF apparatus with improved antenna isolation.

One aspect of the disclosure relates to techniques and processes for the fabrication or production of communication apparatus. FIG. 8 shows a flow diagram 150 for a process of fabricating an RF apparatus with improved antenna isolation.

At 155, substrate 15 is fabricated. As part of the fabrication, a ground plane (e.g., common ground plane 20) and isolation regions are fabricated. At 160, the antennas are fabricated. Two, four, or more antennas of a desired or specified type may be fabricated, as desired.

At 165, the RF current blockers are fabricated. Depending on the number of antennas, two, four, or more RF current blockers may be fabricated and used to improve antenna isolation. The RF blockers may be disposed with respect to the antennas as described above.

At 170, the RF circuits, such as receivers, transmitters, and/or transceivers are fabricated, attached, and/or coupled to the antennas. The RF circuits may be fabricated on or using the substrate, as desired. Alternatively, the RF circuits may be fabricated using one or more integrated circuits (ICs) or multi-chip modules (MCMs), as described below, and coupled or attached to the substrate and the antennas.

As noted above, using the RF current blockers might change the impedance and/or tuning of the antennas. If that is the case, at 175 the antennas are tuned or retuned so that they have the desired or prescribed characteristics.

Figure 9:
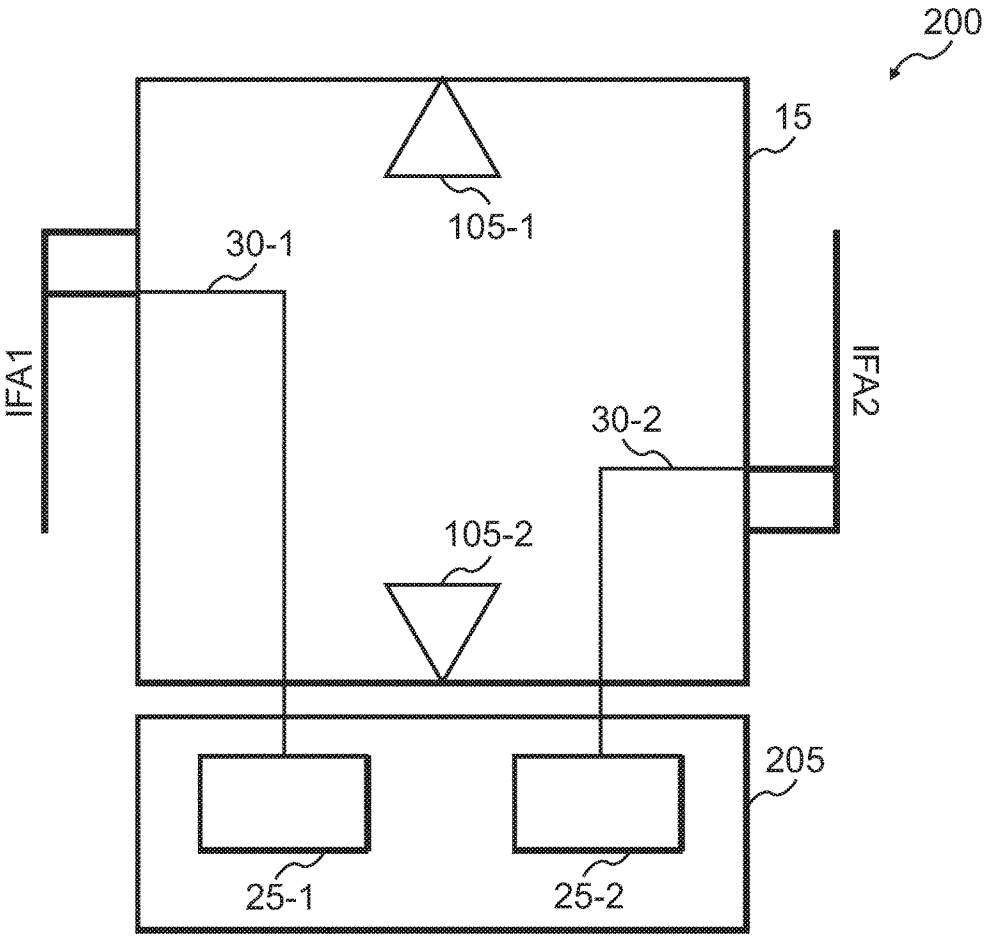
FIG. 9 illustrates a multi-antenna apparatus that includes an integrated circuit (IC) or RF module.

One aspect of the disclosure relates to antenna modules that include RF current blockers. FIG. 9 illustrates an apparatus 200 that includes an IC 205 (or RF module 205 or MCM 205) coupled to an antenna module 15 with improved antenna isolation.

More specifically, antenna module 15 may be fabricated in a number of way, such as using a substrate, as described above. Antenna module 15 includes antenna IFA1, antenna IFA2, link 30-1, link 30-2, and RF current blockers 105-1 and 105-2, as described above.

RF circuits 25-1 and 25-2 reside in IC 205. In the case of an RF module, RF circuits 25-1 and 25-2 are fabricated within the module, for instance, using a PCB or other substrate. In the case of an MCM, RF circuits 25-1 and 25-2 are fabricated using semiconductor die that reside within the MCM.

Note that in addition to RF circuits 25-1 and 25-2, IC 205 (or RF module 205 or MCM 205) may include other circuitry, such as digital circuitry (processors, microcontrollers, memory, input-output circuits, etc.), analog circuitry (amplifiers, signal processing circuitry, etc.), and/or mixed-signal circuitry (e.g., analog to digital converters, digital to analog converters, filters, etc.), as desired.

Figure 10:
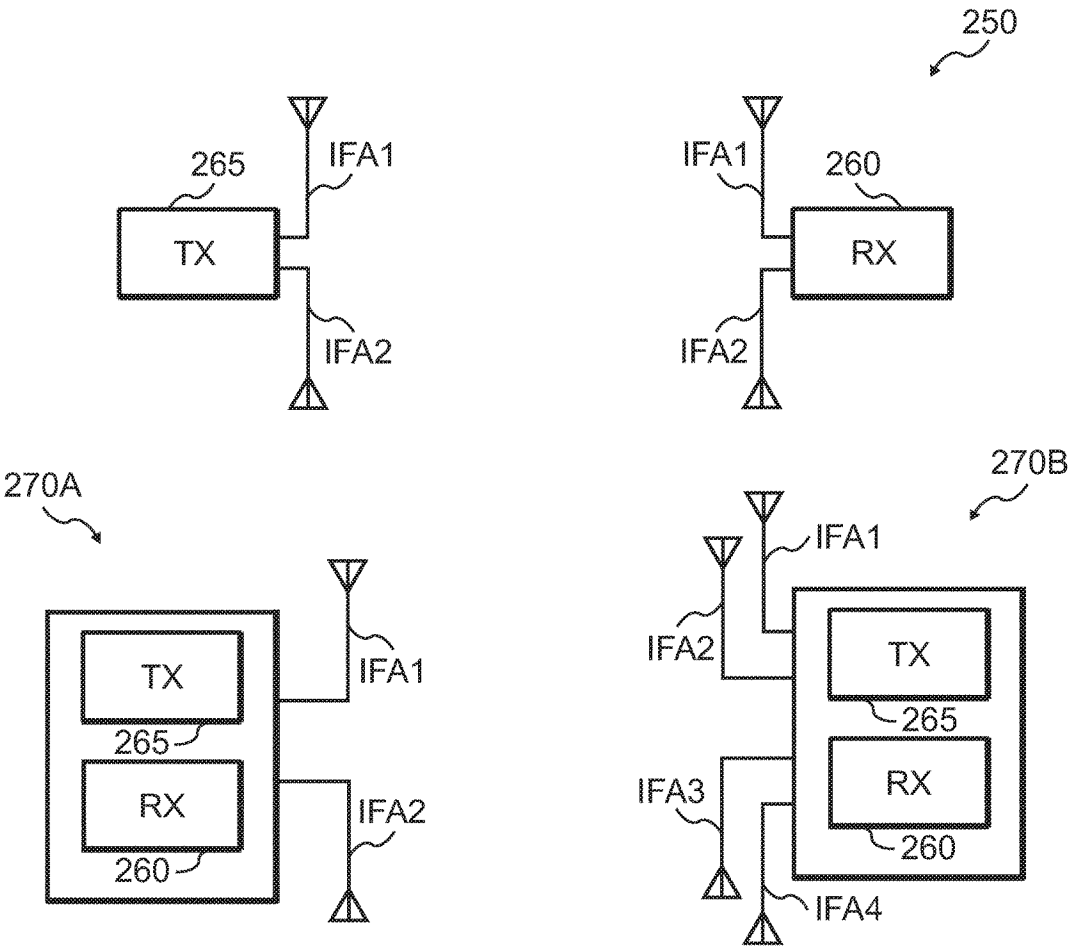
FIG. 10 depicts a system for radio communication using multi-antenna configurations with improved antenna isolation.

One aspect of the disclosure relates to using multi-antenna apparatus with improved antenna isolation in communication systems. FIG. 10 depicts a system 250 for radio communication using a multi-antenna configuration with improved antenna isolation.

System 250 includes a transmitter 265, coupled to antennas IFA1-IFA2. Via antennas IFA1-IFA2, transmitter 265 transmits RF signals. Transmitter 265 includes RF current blockers (not shown) to improve isolation between antennas IFA1-IFA2. Note that rather than using two antennas, other numbers of antennas, such as four, may be used, as desired, by making appropriate modifications, as persons of ordinary skill in the art will understand.

The RF signals from transmitter 265 may be received by receiver 260. Receiver 260 is coupled to antennas IFA1-IFA2. Via antennas IFA1-IFA2, receiver 260 receives RF signals. Receiver 260 includes RF current blockers (not shown) to improve isolation between antennas IFA1-IFA2. Note that rather than using two antennas, other numbers of antennas, such as four, may be used, as desired, by making appropriate modifications, as persons of ordinary skill in the art will understand.

In addition to transmitter 265 and/or receiver 260, or alternatively, transceiver 270A and/or transceiver 270B might receive (via receiver 260) the transmitted RF signals using antennas IFA1-IFA2. Transceiver 270A includes RF current blockers (not shown) to improve isolation between antennas IFA1-IFA2.

Transceiver 270A uses two antennas, IFA1 and IFA2. Note that rather than using two antennas, other numbers of antennas, such as four, may be used, as desired, by making appropriate modifications, as persons of ordinary skill in the art will understand.

Transceiver 270B uses four antennas, IFA1-IFA4. Note that rather than using two antennas, other numbers of antennas, such as two or more than four, may be used, as desired, by making appropriate modifications, as persons of ordinary skill in the art will understand.

In addition to receive capability, transceiver 270A and transceiver 270B can also transmit RF signals. The transmitted RF signals might be received by receiver 260 as a stand-alone receiver, or via the receiver circuitry of the non-transmitting transceiver.

Other systems or sub-systems with varying configuration and/or capabilities, such as the number of antennas and the corresponding number of RF current blockers to improve antenna isolation, are also contemplated. For example, in some exemplary embodiments, two or more transceivers (e.g., transceiver 270A and transceiver 270B) might form a network, such as an ad-hoc network. As another example, in some exemplary embodiments, transceiver 270A and transceiver 270B might form part of a network, for example, in conjunction with transmitter 265. Regardless of the system configuration, RF current blockers may be used to improve antenna isolation, as described above in detail.

Referring to the figures, persons of ordinary skill in the art will note that the various blocks shown might depict mainly the conceptual functions and signal flow. The actual circuit implementation might or might not contain separately identifiable hardware for the various functional blocks and might or might not use the particular circuitry shown. For example, one may combine the functionality of various blocks into one circuit block, as desired. Furthermore, one may realize the functionality of a single block in several circuit blocks, as desired. The choice of circuit implementation depends on various factors, such as particular design and performance specifications for a given implementation. Other modifications and alternative embodiments in addition to the embodiments in the disclosure will be apparent to persons of ordinary skill in the art. Accordingly, the disclosure teaches those skilled in the art the manner of carrying out the disclosed concepts according to exemplary embodiments, and is to be construed as illustrative only. Where applicable, the figures might or might not be drawn to scale, as persons of ordinary skill in the art will understand.

The particular forms and embodiments shown and described constitute merely exemplary embodiments. Persons skilled in the art may make various changes in the shape, size and arrangement of parts without departing from the scope of the disclosure. For example, persons skilled in the art may substitute equivalent elements for the elements illustrated and described. Moreover, persons skilled in the art may use certain features of the disclosed concepts independently of the use of other features, without departing from the scope of the disclosure.

The invention claimed is:

1. An apparatus, comprising:

a first antenna coupled to a first radio frequency (RF) circuit to receive or transmit RF signals;

a second antenna coupled to a second RF circuit to receive or transmit RF signals;

a first RF current blocker, comprising a first slot line radial stub, disposed between the first and second antennas; and a second RF current blocker, comprising a second slot line radial stub, disposed between the first and second antennas, wherein the first and second RF current blockers increase isolation between the first and second antennas.

2. The apparatus according to claim 1, further comprising:

a third antenna;

a fourth antenna;

a third RF current blocker disposed between the third and fourth antennas; and a fourth RF current blocker disposed between the third and fourth antennas.

3. The apparatus according to claim 2, wherein the third RF current blocker comprises a third slot line radial stub, and wherein the fourth RF current blocker comprises a fourth slot line radial stub.

4. The apparatus according to claim 1, wherein the first and second antennas are disposed along opposing edges of a substrate.

5. The apparatus according to claim 4, wherein the first and second RF current blockers are disposed along opposing edges of the substrate.

6. The apparatus according to claim 5, wherein the first and second RF current blockers suppress undesired ground currents that would otherwise flow between the first and second antennas in a ground plane of the substrate.

7. The apparatus according to claim 1, wherein the first and second antennas are tuned to account for effects of the first and second RF current blockers on respective impedances of the first and second antennas.

8. The apparatus according to claim 1, comprising an integrated circuit (IC) and an antenna module, wherein the first and second RF circuits are included in the IC, and wherein the first and second RF current blockers and the first and second antennas are included in the antenna module.

9. An apparatus, comprising:

a first antenna disposed along a first edge of a substrate;

a second antenna disposed along a second edge of the substrate;

a first RF current blocker, comprising a first slot line radial stub, disposed along a third edge of the substrate; and a second RF current blocker, comprising a second slot line radial stub, disposed along a fourth edge of the substrate.

10. The apparatus according to claim 9, wherein the second edge of the substrate is opposite the first edge of the substrate.

11. The apparatus according to claim 10, wherein the third edge of the substrate is opposite the fourth edge of the substrate.

12. The apparatus according to claim 9, wherein the first and second antennas and the first and second RF current blocker are disposed on a substrate having a ground plane, and wherein the first and second RF current blockers suppress undesired ground currents that would otherwise flow, in the ground plane, between the first and second antennas.

13. A method of increasing antenna isolation between first and second antennas in a multi-antenna apparatus, the method comprising:

fabricating the first antenna, the first antenna coupled to a first radio frequency (RF) circuit to receive or transmit RF signals;

fabricating the second antenna, the second antenna coupled to a second RF circuit to receive or transmit RF signals;

fabricating a first RF current blocker, comprising a first slot line radial stub, disposed between the first and second antennas; and fabricating a second RF current blocker, comprising a second slot line radial stub, disposed between the first and second antennas, wherein the first and second RF current blockers increase isolation between the first and second antennas.

14. The method according to claim 13, further comprising:

fabricating a third antenna;

fabricating a fourth antenna;

fabricating a third RF current blocker disposed between the third and fourth antennas; and fabricating a fourth RF current blocker disposed between the third and fourth antennas.

15. The method according to claim 14, wherein the third RF current blocker comprises a third slot line radial stub, and wherein the fourth RF current blocker comprises a fourth slot line radial stub.

16. The method according to claim 13, wherein fabricating the first and second antennas further comprises disposing the first and second antennas along opposing edges of a substrate, and wherein fabricating the first and second RF current blockers further comprises disposing the first and second RF current blockers along opposing edges of the substrate.

17. The method according to claim 13, further comprising tuning the first and second antennas to account for effects of the first and second RF current blockers on respective impedances of the first and second antennas.

18. The method according to claim 16, wherein the first and second RF current blockers suppress undesired ground currents that would otherwise flow between the first and second antennas in a ground plane of the substrate.

19. The method according to claim 13, wherein the first RF circuit is included in an integrated circuit (IC), and wherein the second RF circuit is included in the IC.

20. The method according to claim 13, wherein:

fabricating the first antenna further comprises including the first antenna in an antenna module;

fabricating the second antenna further comprises including the second antenna in the antenna module;

fabricating the first RF current blocker further comprises including the first RF current blocker in the antenna module; and fabricating the second RF current blocker further comprises including the second RF current blocker in the antenna module.

* * * * *